US011346064B2

(12) United States Patent
Dillingham

(10) Patent No.: US 11,346,064 B2
(45) Date of Patent: May 31, 2022

(54) POTHOLE PATCHER WITH EMULSION OIL REJUVENATOR SYSTEM

(71) Applicant: H. D. Industries, Inc., Jacksonville, TX (US)

(72) Inventor: Harold W. Dillingham, Jacksonville, TX (US)

(73) Assignee: H. D. Industries, Inc., Jacksonville, TX (US)

( * ) Notice: Subject to any disclaimer, the term of this patent is extended or adjusted under 35 U.S.C. 154(b) by 26 days.

(21) Appl. No.: 16/597,547

(22) Filed: Oct. 9, 2019

(65) Prior Publication Data

US 2021/0108377 A1 Apr. 15, 2021

(51) Int. Cl.
*E01C 19/00* (2006.01)
*E01C 19/08* (2006.01)
*E01C 23/06* (2006.01)

(52) U.S. Cl.
CPC ..... *E01C 19/08* (2013.01); *E01C 23/06* (2013.01)

(58) Field of Classification Search
CPC ..... E01C 19/08; E01C 23/06
USPC ..... 404/75, 101–111
See application file for complete search history.

(56) References Cited

U.S. PATENT DOCUMENTS 4,159,877 A 7/1979 Jacobson et al.
4,311,274 A * 1/1982 Neal ..... B05B 9/0409 239/1
4,423,980 A * 1/1984 Warnock ..... E01C 19/174 296/37.6
4,887,908 A 12/1989 Montgomery et al.
4,944,632 A 7/1990 Dillingham
4,964,752 A * 10/1990 Astrope ..... B05D 7/22 404/111
5,044,819 A * 9/1991 Kilheffer ..... E01C 19/46 404/72
5,178,487 A * 1/1993 Dresselhaus ..... E01C 23/06 404/107
5,232,306 A * 8/1993 Sterner ..... E01C 23/06 404/107
5,354,145 A * 10/1994 Sterner ..... E01C 23/06 404/107
5,447,388 A * 9/1995 Rouse ..... B01F 3/1221 404/101
5,765,963 A * 6/1998 Roberts ..... E01C 19/16 404/101
5,906,856 A * 5/1999 Roden ..... A23L 29/256 426/603
5,988,935 A 11/1999 Dillingham
6,093,247 A * 7/2000 Sipos ..... B05B 9/002 118/302

(Continued)

*Primary Examiner* — Raymond W Addie
(74) *Attorney, Agent, or Firm* — Whitaker Chalk Swindle & Schwartz PLLC; Charles Gunter

(57) ABSTRACT

A portable device for transporting asphalt repair materials for use in repairing potholes in asphalt pavements. The device has a body with a hopper compartment for transporting and dispensing asphalt mix materials. Emulsion oils are held and dispensed from a separate emulsion oil tank. An emulsion pump provides emulsion oils to a spray wand. The emulsion oil tank includes an emulsion rejuvenator apparatus which works to prevent separation of the emulsion oils. A control circuit actuates the rejuvenator any time that the emulsion pump is turned on to supply emulsion oils to a spray wand to spray emulsions onto the road repair site.

4 Claims, 4 Drawing Sheets

(56) References Cited

U.S. PATENT DOCUMENTS

| | | | | |
|---|---|---|---|---|
| 6,109,826 | A * | 8/2000 | Mertes | E01C 19/45 392/472 |
| 6,183,161 | B1 * | 2/2001 | Neeper | B05B 7/162 165/163 |
| 7,993,441 | B2 | 8/2011 | Kleiger et al. | |
| 8,931,975 | B2 * | 1/2015 | Warlow | E01C 19/002 404/92 |
| 10,260,208 | B1 | 4/2019 | Dillingham | |
| 2007/0085234 | A1 * | 4/2007 | Boyle | B29C 41/28 264/216 |
| 2009/0303828 | A1 * | 12/2009 | Van Zante | E01C 23/06 366/8 |

* cited by examiner

POTHOLE PATCHER WITH EMULSION OIL REJUVENATOR SYSTEM

BACKGROUND OF THE INVENTION

1. Field of the Invention

The present invention relates generally to truck and/or trailer mounted portable devices for dispensing pavement repair materials and, specifically, to such a portable device having a separate tank for dispensing asphalt emulsions as repair materials for asphalt pavements.

2. Description of the Prior Art

In the past, as many as three vehicles were sometimes needed to repair openings and potholes in asphalt, concrete and other roadway surfaces. One vehicle provided an air compressor for use with various pneumatic repair tools which were used to dress the hole, crack or cavity to be filled. Another vehicle contained liquid asphalt tack material which would be sprayed into the dressed cavity, and a third vehicle would deliver asphalt mix material to the cavity. The asphalt would then be packed, compacted and leveled by hand to complete the repair.

U.S. Pat. No. 4,944,632, issued Jul. 31, 1990, entitled "Device For Dispensing Asphalt Repair Materials", assigned to the assignee of the present invention, shows an improved device of the type used for transporting asphalt repair materials for use in repairing potholes in asphalt pavements. This device was a portable machine designed to incorporate all phases of the pavement repair into one mobile unit. The device had a body with a hopper compartment for transporting and dispensing asphalt mix materials. A heat transfer oil tank was located below the hopper compartment and was heated by a retort tube propane burner. A separate emulsion oil/tack material tank was provided with an internal circulation system to assist in maintaining liquid emulsion oils in an emulsified state. Emulsion oils or asphalt tack materials were dispensed from the emulsion oil tank by means of spray equipment connected to a discharge valve on the rear of the truck.

U.S. Pat. No. 5,988,935, issued Nov. 23, 21999, entitled "Asphalt Repair Apparatus With Dry, Heat Source" and U.S. Pat. No. 6,681,761, issued Jan. 27, 2004, entitled "Exhaust Damper System For Asphalt Heating Device", both assigned to the assignee of the present invention show additional improvements in this same basic design of asphalt repair machine, although not specially dealing with the emulsion oil tank.

In spite of these improvements, a problem sometimes occurs with separation of the emulsion oils contained in the separate emulsion oil tank. These oils are generally petroleum and animal fat products that are emulsified. Most such oils are intended for immediate use or otherwise the water content of the oil separates from the base material. As a result, one of the major problems that all municipalities have with emulsion oils is that about 72 hours after purchase, the emulsion oil begins to separate. This causes the emulsion pump and associated lines to stop-up and allows sludge build-up in the emulsion tank. Previously, the emulsion oils were remixed for use by using the spray applicator pump to recirculate the materials within the tank, or the materials were manually remixed. Both methods were inefficient and time consuming. Additionally, operators sometimes failed to run the pump system where keeping it running would have solved the emulsion separation problem.

A need exists, therefore, for an improved method and apparatus for dispensing emulsion oil which prevents phase separation of the emulsion oil materials for extended periods of time. There also exists a need for such an emulsion delivery system which would be automatically actuated at the time the operator starts the emulsion pump, eliminating operator error or poor application practices.

There also exists a need for such an emulsion delivery system which is relatively simple in design and economical to manufacture and which is reliable in operation in a variety of temperatures and weather conditions.

SUMMARY OF THE INVENTION

The present invention deals with improvements to an emulsion oil system for a pothole repair apparatus of the type used to repair potholes on asphalt roadways and other traffic bearing surfaces. The emulsion oil system could be adapted to any number of asphalt transport vehicles. One preferred vehicle of this type includes a body adapted to be mounted on a portable base for transporting the body to a repair site. The body has a hopper compartment with a V-shaped bottom wall for transporting asphalt mix material and a generally V-shaped heating chamber located below the hopper compartment. The V-shaped bottom wall of the hopper compartment defines an upper extent of the heating chamber. An auger or screw conveyor is mounted in the bottom of the hopper compartment for dispensing asphalt mix materials therefrom. An agitator, such as a paddle shaft, is located above the auger in the hopper compartment for agitating the hopper materials.

An emulsion oil tank is mounted on the vehicle in proximity to the hopper compartment. The emulsion oil tank has a bottom wall, a top wall and interconnecting sidewalls which together define a closed interior having a bottom region and a top region, respectively. The closed interior is supplied with a preselected level of emulsion oil which comprises a liquid-liquid emulsion. A heat exchanger is located within the emulsion oil tank for heating the emulsion oil to thereby assist in maintaining the emulsion oil in a liquid state.

The emulsion oil tank includes an emulsion pump assembly as one integral component. The emulsion pump assembly includes an emulsion pump having an inlet conduit for collecting liquid from the bottom portion of the emulsion oil tank and an outlet conduit leading to a selector valve, the selector valve being connected to a spray wand used for spraying emulsion oil onto a road surface to be repaired. The selector valve is operable between a spray on position and a spray off position. The selector valve also includes a recirculation conduit for recirculating emulsion oil back to a top portion of the emulsion oil tank when the valve is moved from the spray on to the spray off position.

An emulsion rejuvenator assembly is also located on the emulsion tank. The emulsion rejuvenator has an auger section with an auger blade vertically mounted in a support cage located within the interior of the emulsion oil tank. The emulsion rejuvenator has an auger motor for turning the auger blade when the motor is switched from an off state to an on state. Actuation of the auger blade serves to agitate emulsion oil in the tank to prevent separation of the emulsion oils contained therein.

A controller is used to supply a control signal simultaneously to both the emulsion pump and to the emulsion rejuvenator motor to power the same on and off simultaneously. In this way, powering the emulsion pump motor causes emulsion oil to be pumped from the pump inlet to the pump outlet and to the selector valve and from the selector valve to the spray wand to be dispensed by the spray wand when the spray wand is in the spray on position and back to the emulsion oil tank when the spray wand is in the spray off position. The simultaneous actuation of the rejuvenator motor causes the auger blade to move to further agitate the emulsion oil within the emulsion oil tank.

The controller can be a controller selected from among the group consisting of hydraulic controllers, electric controllers and pneumatic controllers, for example.

In one preferred form of the invention, the controller is a hydraulic controller. The control system uses a hydraulic valve body for supplying a flow of hydraulic fluid simultaneously to both the emulsion pump and to the emulsion rejuvenator motor to power the same on and off simultaneously. As has been described, powering the emulsion pump motor causes emulsion oil to be pumped from the pump inlet to the pump outlet and to the selector valve and from the selector valve to the spray wand to be dispensed by the spray wand when the spray wand is in the spray on position and back to the emulsion oil tank when the spray wand is in the spray off position. Actuation of the hydraulic valve body causes a hydraulic fluid flow to be partially diverted through a hydraulic flow controller to the auger motor of the emulsion rejuvenator assembly. The simultaneous actuation of the rejuvenator motor causes the auger blade to move to further agitate the emulsion oil within the emulsion oil tank.

A method is also shown for repairing a pothole in an asphalt pavement using an apparatus of the type previously described. Emulsion oil is dispensed from the emulsion oil tank through the hand held spray wand onto the pothole to be repaired in order to prepare the surface thereof. As has been described, powering the emulsion pump motor causes emulsion oil to be pumped from the pump inlet to the pump outlet and to the selector valve and from the selector valve to the spray wand to be dispensed by the spray wand when the spray wand is in the spray on position and back to the emulsion oil tank when the spray wand is in the spray off position. The simultaneous actuation of the rejuvenator motor causes the auger blade to move to further agitate the emulsion oil within the emulsion oil tank to prevent separation of the phases of the emulsion. Asphalt mix repair materials are also dispensed from the hopper compartment to fill and repair the pothole.

Additional objects, features and advantages will be apparent from the written description which follows.

DETAILED DESCRIPTION OF THE INVENTION

The present invention provides a pothole patcher which meets the foregoing described objectives. Problems relating to separation of the oil emulsion in the emulsion oil tank are prevented with the addition of the new emulsion oil rejuvenator system. The invention described herein and the various features and advantageous details thereof are explained more fully with reference to the non-limiting examples which are illustrated in the accompanying drawing and detailed in the following description. Descriptions of well-known components and processes and manufacturing techniques are omitted so as to not unnecessarily obscure the workings of the invention. The examples used herein are intended merely to facilitate an understanding of ways in which the invention herein may be practiced and to further enable those of skill in the art to practice the invention. Accordingly, the examples should not be construed as limiting the scope of the claimed invention.

The emulsion oil system of the invention which will be described in detail can be adapted for use with various asphalt repair vehicles such as truck mounted systems, skids, trailers and dump body mounts. The invention will be described herein with respect to a truck mounted system of the type sold commercially as the Pro-Patch™ Pot Hole Patcher by H.D. Industries, Inc., of Jacksonville, Tex. This truck mounted system is capable of making permanent asphalt repairs under a variety of weather conditions and can transport hot or cold asphalt pre-mix material as well as emulsions and tack oils at controlled heated temperatures. Typical systems are provided as 3-6 cubic yard hoppers. Heating systems include dry heat or heat transfer oil. Heating sources include LP gas, CNG, diesel or all electric heat with an on-board generator.

Figure 1:
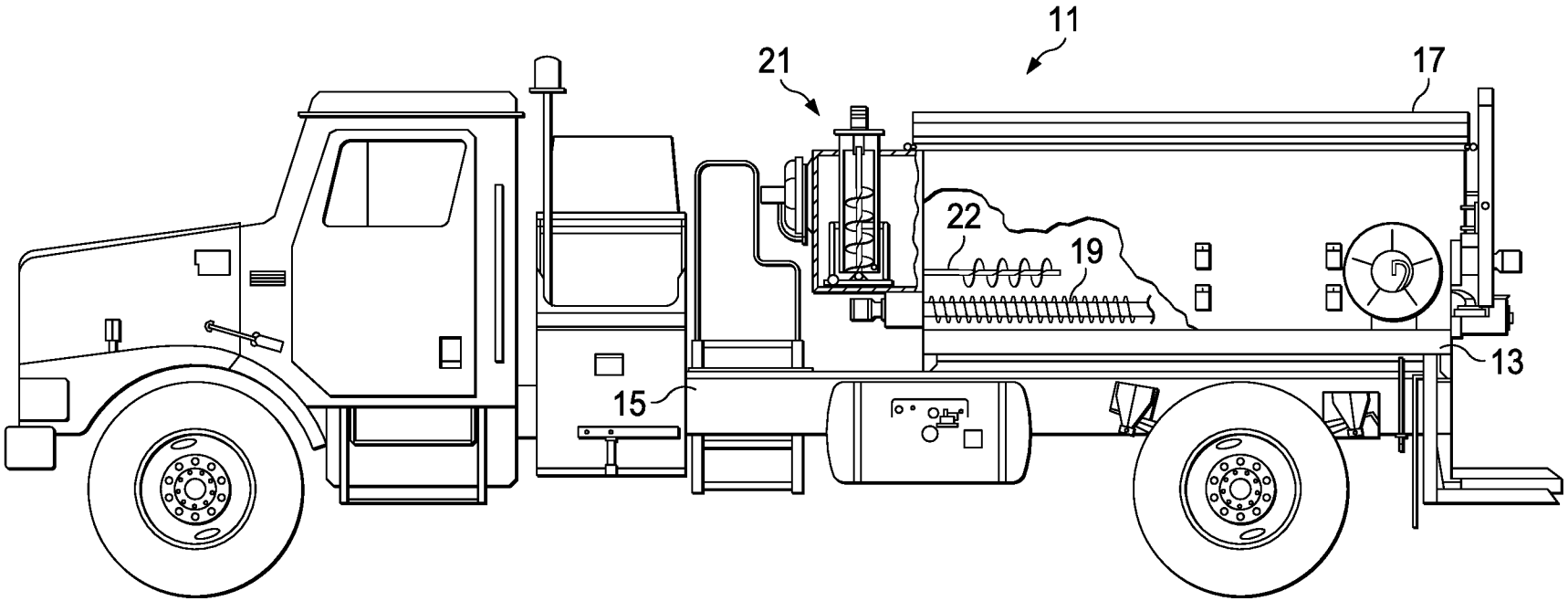
FIG. 1 is a perspective view, partly broken away, of the improved asphalt dispensing body of the invention, showing the V-shaped hopper, the screw conveyor, paddle shaft and showing the improved emulsion oil tank which is the subject of the invention.

FIG. 1 is a simplified view, partly broken away of such an asphalt repair vehicle, designated generally as 11. The repair vehicle 11 includes a body 13 which is adapted to be mounted on a portable base. In this case, the body is mounted on the truck bed 15. The body has a hopper compartment 17 for transporting asphalt mix materials. For the purposes of the present discussion the following terms will have the following meanings:

"Asphalt" is generally defined as the residual material obtained from the distillation of asphalt-based petroleum. Chemically, asphalts are complex aggregations of rather large aliphatic and cyclic hydrocarbon molecules. Asphaltic mixtures are comprised of mineral aggregate and bituminous constituents and are widely used in the road construction industry. The major types of asphaltic mixtures are used today in highway construction and maintenance include: hot mixes; cut-backs; anionic emulsions; and cationic emulsions. Hot mix asphalts are used extensively in main highway construction where greater durability is required. These asphalts are characterized by a high asphaltene content making them very hard and resistant to chemical decomposition. Cut-back asphalts are formed by the use of an inexpensive petroleum solvent which along with the asphalt is mixed with the aggregate. The solvent evaporates leaving the asphalt binder in use. Generally, light petroleum oils or napthas are used as solvents.

The two final forms of commonly used asphalts include anionic emulsions and cationic emulsions. As their name implies, such emulsions are formed by the use of anionic or cationic emulsifiers for forming an oil-in-water emulsion which can be combined with aggregate for use in the road construction industry. Another definition of these materials is that asphalt emulsions are a type of liquid cement that is combined with water and an emulsifying agent. The emulsifying agent keeps the asphalt molecules together, which greatly improves the asphalt's binding properties. Emulsions are environmentally safe, energy efficient and cost effective way to do asphalt repair.

"Aggregate" used in road construction will be understood to include various mineral materials such as sand, rock, or the like, typically native to the localities where the roads are being built. For example, limestone, dolemite, silica, sedimentary, metamorphic, or igneous rocks of various other kinds regularly are used in road building.

In summary, in the discussion which follows, "asphalt mix" materials will be taken to mean pre-mix or aggregate hot or cold mix asphalt and asphalt aggregate. The term "liquid asphalt emulsion" or "emulsion oil" will be taken to mean asphaltic cements, liquid asphalts, tack oils and asphalt emulsions of the type carried in a separate emulsion oil tank, as will be described.

As has been mentioned, the base vehicle shown in FIG. 1 is sold commercially as the Pro-Patch™ Pot Hole Patcher by H.D. Industries Inc., of Jacksonville, Tex. However, in the case of the vehicle shown in FIG. 1, that vehicle has been equipped with the improved emulsion oil tank which is the subject of the invention. As will be familiar to those skilled in the relevant arts, the hopper compartment of the standard Pro-Patch™ Pot Hole Patcher shown in FIG. 1 has a V-shaped bottom wall which forms an upper, uninsulated common wall of a V-shaped heating chamber. The body 13 of the portable device is also equipped with an auger or screw convey (shown in simplified form as 19 in FIG. 1) which is mounted in the bottom region of the hopper which forms a trough-like opening extending longitudinally along the bottom wall thereof. The screw conveyor 19 is used to dispense asphalt mix materials contained within the hopper. An agitator, such as paddle shaft 22 (shown broken away in FIG. 1) is located above the screw conveyor 19 in the hopper compartment for agitating the hopper materials contained therein.

The screw conveyor 19 can be, for example, 10 feet long by 6 inches diameter progressive screw conveyor with hard surfaced flights welded continuously on 2 inch scheduled 80 steel pipe and is ball bearing mounted. The conveyor is, in one case, driven by a 9200 in.lb. torque variable speed hydraulic motor with forward and reverse. It is used to feed a delivery chute (not shown) with 120° of pivot. The paddle shaft 22 is used to break up asphalt due to vibratory compaction. In one embodiment, it is a schedule 160 shaft with 12 spikes and is ball bearing mounted and driven by a 9,200 in.lb. torque variable speed hydraulic motor with forward and reverse.

As those skilled in the relevant arts will appreciate, any of a number of different heating systems can be used to heat the hopper compartment by transferring heat to the bottom V-shaped wall of the hopper compartment for maintaining the asphalt repair materials contained therein in a workable state. These heating systems include LP gas, CNC gas, diesel-fired and all electric truck mounted units. These heat sources may be used for example in either dry heat systems or heat transfer oil systems and are all commercially available. In the case of the dry heat system, for example, a pair of oppositely arranged retort tubes are located within the heating chamber formed on either side of the V-shaped bottom wall of the hopper. The retort tubes are each heated by a 150,000 btu retort tube propane burner. The burners are thermostatically controlled and regulated at 10 psi. The burners utilize commercially available ignition systems, such as a 12 volt DC electronic igniter. The gas burner is preferably provided with a safety shut-off on loss of flame or excessive temperature. The commercially available burner, ignition and safety shut-off system for the retort tubes can be obtained from H. D. Industries, Inc., of Jacksonville, Tex. The commercially available burner has two stages, ignites on 10 ounces of pressure and operates at 10 psi. The retort tubes are used to supply dry, radiant heat to the bottom wall of the hopper compartment. Each retort tube forms a single pass loop which has a burner installed at one extent thereof and which communicates with an exhaust conduit such as an exhaust stack at an opposite extent thereof. The dry heat system is described in detail in Applicant's issued U.S. Pat. No. 5,988,935, issued Nov. 23, 1999.

The foregoing description is intended to explain the general environment of the present invention in terms of a commercially available asphalt dispensing device presently available in the marketplace. The invention, however, deals with the emulsion tank which is used to dispense emulsion oils to the road repair site.

Thus in FIG. 1, a separate emulsion oil tank, designated generally as 21, is mounted on the portable base at one end of the hopper compartment 17 for transporting and dispensing emulsion oils including road oils, cutbacks, asphaltic cements, liquid asphalts and emulsions. However, the invention has particular applicability to emulsion oils.

The separate liquid asphalt tank could take the form of, for example, the tank described in issued U.S. Pat. No. 4,944,632, issued Jul. 31, 1990, supra, and assigned to the assignee of the present invention. That tank is provided with an internal circulation system for maintaining liquid emulsion oils in an emulsified state. In one preferred form, that particular emulsion tank has an 80 gallon capacity and is double steel jacketed with 2" of insulation. During working hours, a heat transfer system is used which is capable of heating emulsion oil from 0° to 150° F., using the truck engine coolant system as the heat source.

Figure 2:
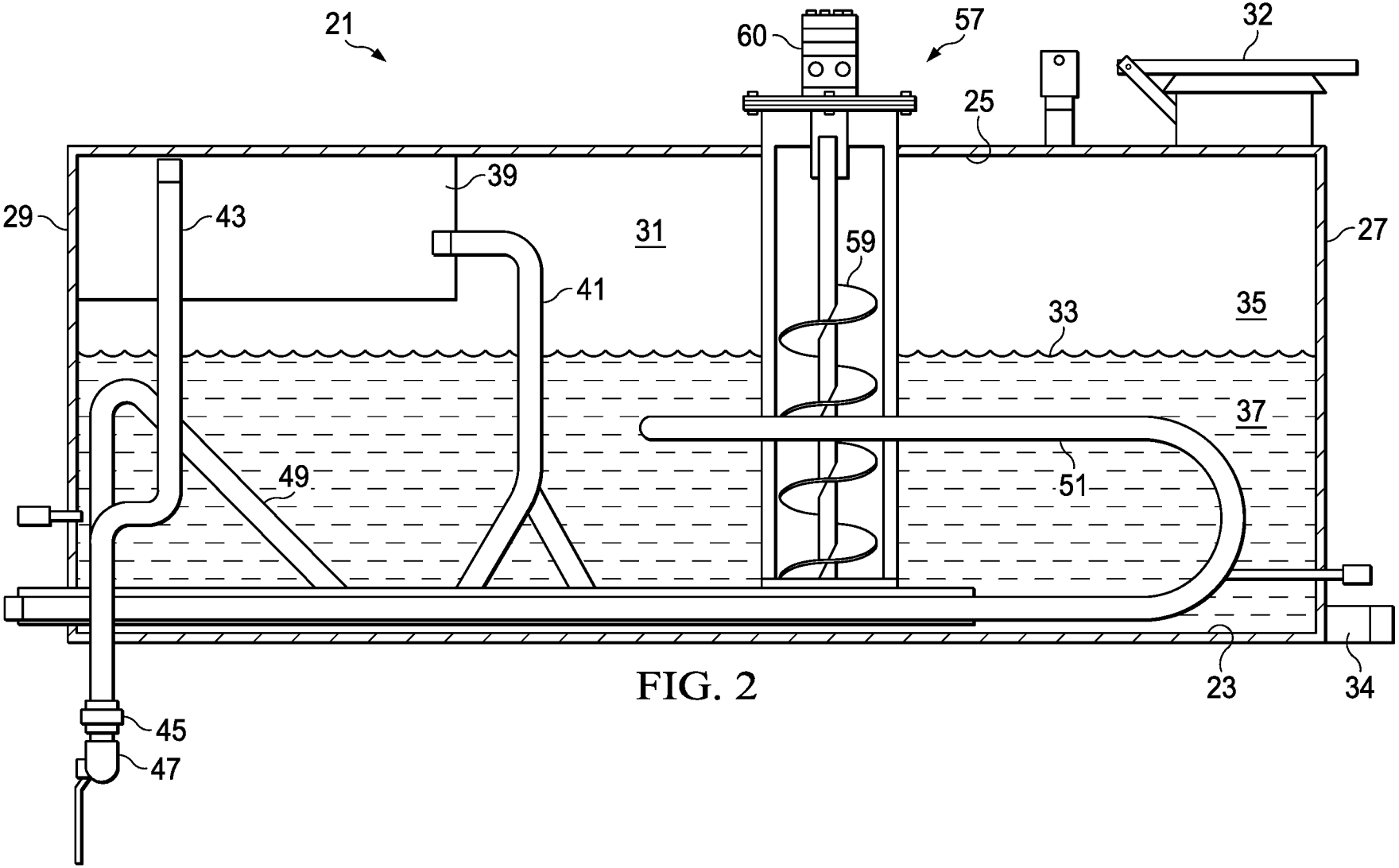
FIG. 2 is a simplified side view of the emulsion oil tank of the invention, partially in section, showing the principal internal components thereof.
Figure 3:
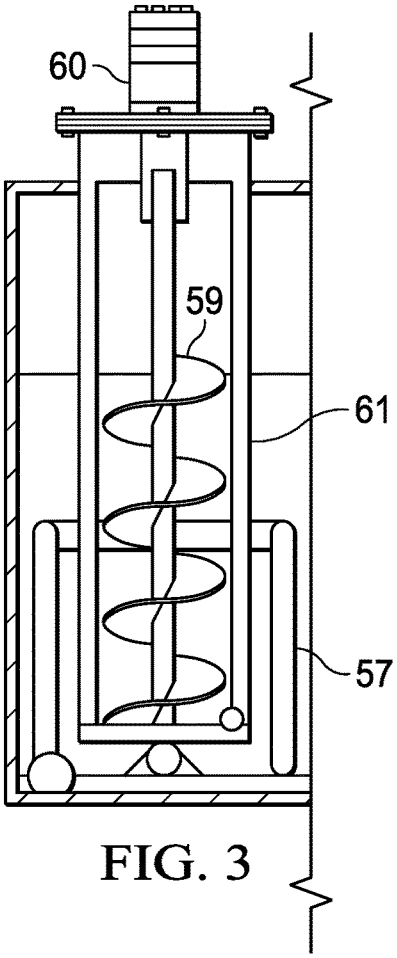
FIG. 3 is a right end view of the emulsion oil tank of FIG. 2.
Figure 4:
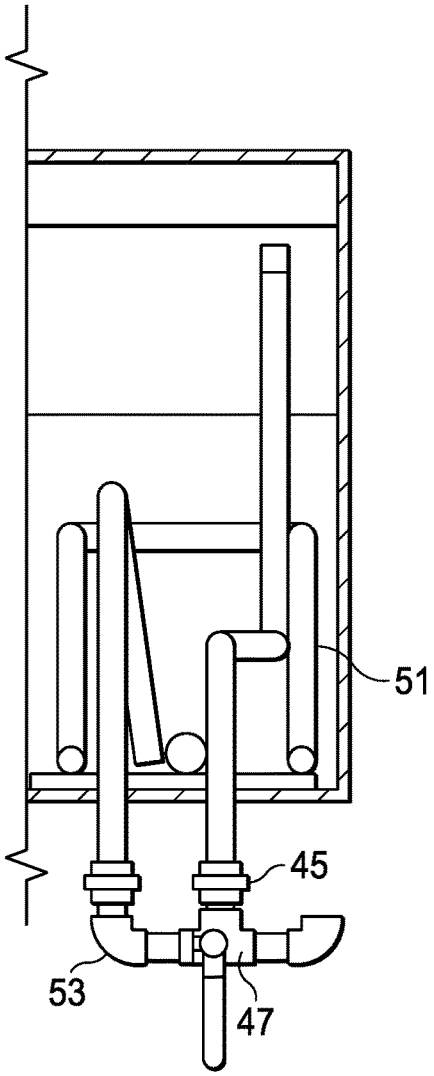
FIG. 4 is a left end view of the emulsion oil tank of FIG. 2.

With reference now primarily to FIGS. 1 and 2, it can be seen that the improved emulsion oil tank 21 of the invention has a bottom wall 23, a top wall 25, and interconnecting sidewalls 27, 29, which together define a closed interior 31. The closed interior 31 is supplied with a preselected level of emulsion oil which comprises a liquid-liquid emulsion. The closed interior 31 is filled with emulsion oil, by means of a fill cap 3 to a preselected level, in this case indicated by the line 33 in FIG. 2, thereby dividing the tank closed interior into a top region 35 and a bottom region 37, respectively. The level 33 of emulsion oil is below the top wall 25. A dipstick can be provided to monitor the level of emulsion oil within the tank. The tank also has a 2" drain (34 in FIG. 2). Circulating means, including hydraulic pump 39 are provided within the tank 21 to circulate emulsion oil from the bottom portion 37 to the top portion 35 thereof. The pump 39 has an inlet conduit (41 in FIG. 2) for collecting liquid from the bottom portion 37 of the tank and an outlet conduit 43 leading to the top portion 35. As will be described more fully, the outlet conduit 43 has a junction 45 which connects a hand held spray wand (not shown). A valve 47 located at the junction 45 controls the supply of liquid to the spray wand. In the example shown in FIG. 2, the pump circuitry also includes a dump line 49.

Some type of primary heat transfer apparatus is also located within the tank 21 to heat the emulsion oil to thereby maintain the emulsion oil in a liquid state. To take one example, the heat transfer system can include an internally submerged retort tube (51 in FIG. 2) which is heated by a thermostatically controlled gas burner (not shown). This type heating system is described in Applicant's issued U.S. Pat. No. 4,944,632, issued Jul. 31, 1990, and other places, and will be familiar to those skilled in the relevant arts. As shown in FIG. 2, the retort tube 51 is provided in the shape of a horizontal "U." The retort tube has a pair of outlets to the exterior of the tank 21. One of the outlet communicates with the gas burner while the other outlet is joined to an external exhaust conduit which is mounted in vertical fashion on the side of the tank. The emulsion oil tank may also be outfitted with an electric heater for use in heating the emulsion oil for overnight situations, or other non-working hours. The electric heater could be, for example, a 220 volt, thermostatically controlled immersion electric heater.

Figure 5:
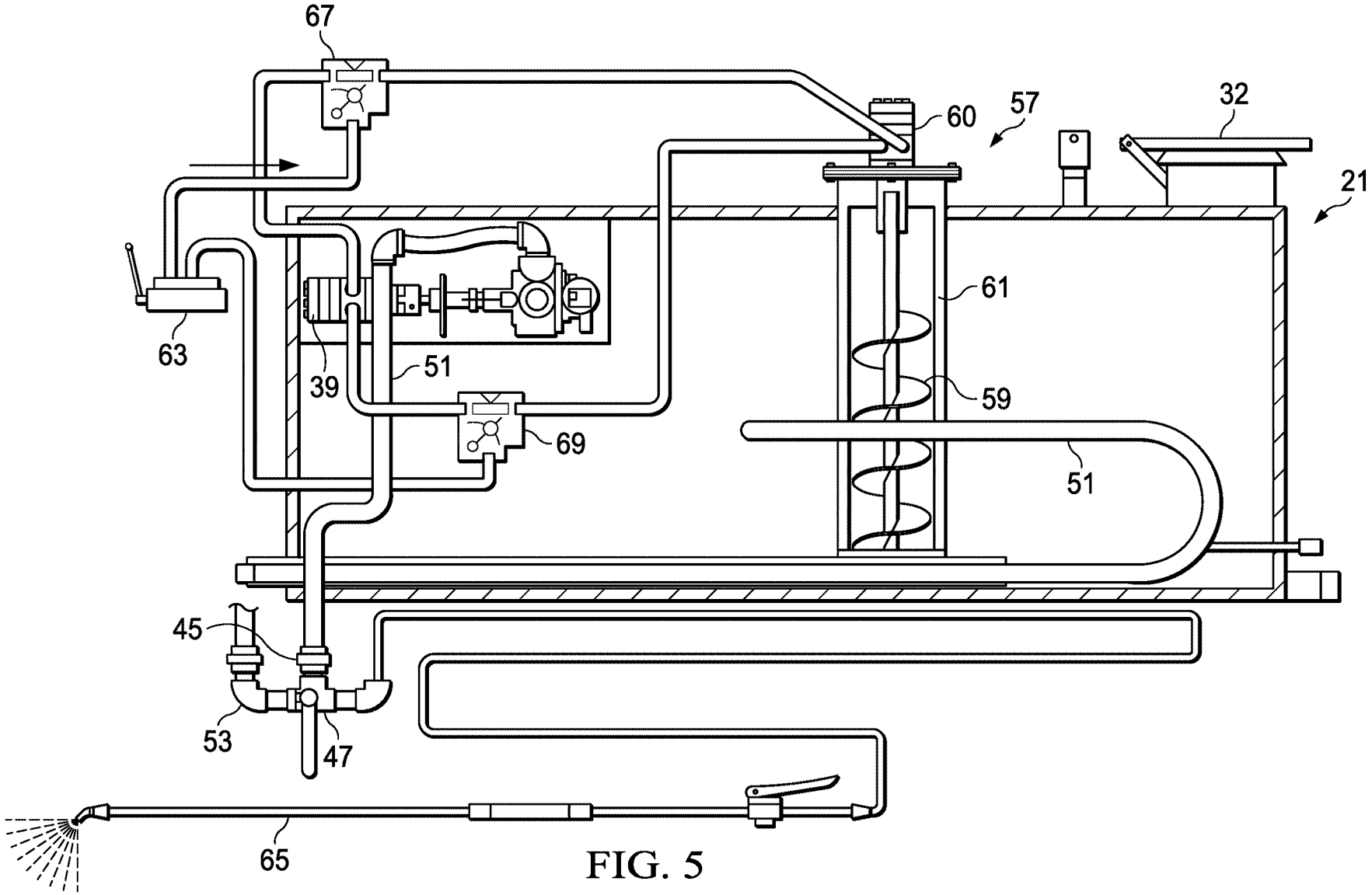
FIG. 5 is a schematic side view of the emulsion oil tank of FIG. 2, showing portions of the hydraulic control circuits used therein.

Turning now to FIG. 5, the improved emulsion tank of the invention is shown in greater detail. An emulsion pump assembly includes the previously described emulsion pump 39 having an inlet conduit for collecting liquid from the bottom portion of the emulsion oil tank and an outlet conduit leading to a selector valve 47, the selector valve being connected to a spray wand 49 used for spraying emulsion oil onto a road surface to be repaired. The selector valve 49 is operable between a spray on position and a spray off position. The selector valve also includes a recirculation conduit 53 for recirculating emulsion oil back to a top portion of the emulsion oil tank when the valve is moved from the spray on to the spray off position.

An emulsion rejuvenator assembly (designated generally as 57) is located on the emulsion tank including a rejuvenator motor 60. The emulsion rejuvenator has an auger section with an auger blade 59 vertically mounted in a support cage 61 located within the interior of the emulsion oil tank. Actuation of the auger blade serves to agitate emulsion oil in the tank to prevent separation of the emulsion oils contained therein. The rejuvenator motor 60 turns the auger blade 59 when the motor is switched from an off state to an on state.

A controller is used to supply a control signal simultaneously to both the emulsion pump 39 and to the emulsion rejuvenator motor 60 to power the same on and off simultaneously. In this way, powering the emulsion pump motor 39 causes emulsion oil to be pumped from the pump inlet to the pump outlet and to the selector valve 47 and from the selector valve 47 to the spray wand (65 in FIG. 5) to be dispensed by the spray wand when the spray wand is in the spray on position and back to the emulsion oil tank when the spray wand is in the spray off position. The simultaneous actuation of the rejuvenator motor 60 causes the auger blade 59 to move to further agitate the emulsion oil within the emulsion oil tank.

As will be apparent from the description which follows, the controller can be a controller selected from among the group consisting of hydraulic controllers, electric controllers and pneumatic controllers. In other words, the rejuvenator motor can be hydraulic, electric or air operated.

In one preferred form of the invention, the controller is a hydraulic controller as shown in FIG. 5. The control system shown in FIG. 5 uses a hydraulic valve body 63 for supplying a flow of hydraulic fluid simultaneously to both the emulsion pump 39 and to the emulsion rejuvenator motor 60 to power the same on and off simultaneously. Powering the emulsion pump motor 60 causes emulsion oil to be pumped from the pump inlet to the pump outlet and to the selector valve 47 and from the selector valve 47 to the spray wand (65 in FIG. 5) to be dispensed by the spray wand 65 when the spray wand is in the spray on position and back to the emulsion oil tank when the spray wand is in the spray off position. The simultaneous actuation of the rejuvenator motor 60 causes the auger blade 59 to move to further agitate the emulsion oil within the emulsion oil tank. The actuation of the hydraulic valve body 63 turns on the emulsion pump assembly to spray emulsions onto a road repair site. As can be appreciated from FIG. 5, actuation of the hydraulic valve body 63 causes a hydraulic fluid flow to be partially diverted through a first hydraulic flow controller 67 to the auger motor 60 of the emulsion rejuvenator assembly. Hydraulic fluid flows back to the inlet of the emulsion pump through a second hydraulic flow controller 69. The motor 60, in the example shown, is bidirectional in operation.

The operation of the asphalt dispensing apparatus of the invention will now be briefly described. Asphalt contained in the hopper region (17 in FIG. 1) of the vehicle 11 is heated in the usual manner, as by using a suitable heat transfer oil and propane burner system or using a dry heat system. In the case of the heat transfer oil system, the burner heats the heat transfer oil which, in turn, heats the asphalt mix in the hopper compartment 17. The emulsion oil in the emulsion oil tank 21 is being continuously recirculated by means of the pump (39 in FIG. 5) so that emulsion oil is dispensed downwardly within the tank 21 onto the top of the liquid level (33 in FIG. 2) therein to maintain the emulsion oils in an emulsified state. At the job site the cavity to be repaired is dressed, as with a hydraulic jack hammer, and valve (47 in FIG. 5) is opened so that hand-held wand 65 is supplied with liquid asphalts or emulsions to seal and tack the dressed cavity. The screw conveyor (19 in FIG. 1) is then actuated to dispense asphalt mix materials from the hopper compartment 17 through a discharge chute into the cavity as required. The filled cavity can then be compacted with a hydraulic tamper to complete the job.

An invention has been provided with several advantages. The device is simpler in design and economical to manufacture. The improved emulsion oil tank includes a special controller which automatically actuates the rejuvenator motor and auger whenever the selector valve is turned to supply emulsion oil to the spray wand. This ensures that the emulsion oils in the emulsion oil tank will be kept in the emulsified state and prevent separation of the respective emulsion components. Without the rejuvenator system of the invention, emulsion oils tend to begin to separate within about 72 hours after purchase. Separation of the components of the emulsion causes the emulsion pump and associated circulation lines to stop-up, as well as allowing the build-up of sludge in the emulsion tank. The rejuvenator system which has been described has been found to reduce this problem on the order of about 95 percent.

While the invention has been shown in only one of its forms, it is not thus limited but is susceptible to various changes and modifications without departing from the spirit thereof, as described in the claims which follow.

What is claimed is:

1. A portable device for transporting asphalt repair materials for use in repairing potholes in asphalt pavements comprising, in combination;

a body adapted to be mounted on a portable base for transporting the body to a repair site, the body having a heated hopper compartment for transporting asphalt mix materials;

a screw conveyor mounted in the bottom of the hopper compartment for dispensing asphalt mix materials therefrom;

a paddle shaft located above the screw conveyor in the hopper compartment for agitating the hopper materials;

a separate emulsion oil tank mounted on the portable base far transporting and dispensing emulsion oils, the emulsion oils comprising a liquid-liquid emulsion and being dispensed to dress the pothole prior to dispensing the asphalt mix materials, the emulsion oil tank having a bottom wall, a top wall and interconnecting sidewalls which together define a closed interior having a bottom region and a top region, respectively, the closed interior being supplied with a preselected level of emulsion oil which comprises a liquid-liquid emulsion;

a heat exchanger located within the emulsion oil tank for heating the emulsion oil to thereby maintain the emulsion oil in a liquid state;

an emulsion pump assembly in communication with the emulsion oil tank, the emulsion pump assembly including an emulsion pump having an inlet conduit for collecting liquid from the bottom portion of the emulsion oil tank and an outlet conduit leading to a selector valve, the selector valve being connected to a spray wand used for spraying emulsion oil onto a road surface to be repaired, wherein the selector valve is operable by the action of an operator between a spray on position, and a spray off position, the selector valve also including a recirculation conduit for recirculating emulsion oil back to a top portion of the emulsion oil tank when the valve is moved from the spray on to the spray off position;

an emulsion rejuvenator assembly located on the emulsion tank, the emulsion rejuvenator having an auger section with an auger blade vertically mounted in a support cage located within the interior of the emulsion oil tank, the auger blade having a series of at least three helically arranged flutes which are arranged perpendicular to the bottom wall of the emulsion tank, actuation of the auger blade serving to agitate emulsion oil in the tank to prevent separation of the emulsion oils contained therein, the emulsion rejuvenator having a bi-directional auger motor for turning the auger blade when the motor is switched from an off state to an on state;

a hydraulic valve body for actuating both the emulsion pump assembly and the emulsion rejuvenator assembly whenever the operator actuates the spray wand or turns on the emulsion pump, by supplying a control signal simultaneously to both the emulsion pump and to the emulsion rejuvenator motor to power the same on and off simultaneously, whereby powering the emulsion pump motor causes emulsion oil to be pumped from the pump inlet to the pump outlet and to the selector valve and from the selector valve to the spray wand to be dispensed by the spray wand when the spray wand is in the spray on position and back to the emulsion oil tank when the spray wand is in the spray off position, the simultaneous actuation of the rejuvenator motor causing the auger blade to move to further agitate the emulsion oil within the emulsion oil tank, actuation of the hydraulic valve body causes hydraulic fluid flow to be partially diverted through a first hydraulic flow controller to the bi-directional auger motor of the emulsion rejuvenator assembly, hydraulic fluid also being allowed to flow back to the inlet of the emulsion pump through a second hydraulic flow controller.

2. The device of claim 1, wherein the heat exchanger located within the emulsion oil tank includes an internally submerged retort tube which is heated by a thermostatically controlled gas burner.

3. The device of claim 2, wherein the retort tube is provided in the shape of a horizontal U having a pair of outlets to the exterior of the tank, one of the outlets having the burner mounted therein and the other of the outlets serving as an exhaust conduit.

4. A method for an operator to repair a pothole in an asphalt pavement, comprising the steps of:

providing a body on a portable base for transporting the body to a repair site, the body being equipped with a hopper compartment with a bottom wall for transporting asphalt mix materials;

providing a separate emulsion oil tank mounted on the portable base for transporting and dispensing emulsion oils which comprise liquid-liquid emulsions, the emulsion oil tank having a bottom portion and a top portion, respectively and being supplied with a preselected level of emulsion oil;

mounting an emulsion pump on the emulsion oil tank to continuously recirculating the emulsion oil within the emulsion oil tank through a conduit from the bottom portion of the tank to the top portion thereof, and wherein the emulsion pump is also provided with an inlet conduit for collecting liquid from the bottom, portion of the emulsion oil tank and an outlet conduit leading to a selector valve, the selector valve being connected to a spray wand used for spraying emulsion oil onto a road surface to be repaired, wherein the selector valve is operable by the action of the operator between a spray on position and a spray off position, the selector valve also including a recirculation conduit for recirculating emulsion oil back to a top portion of the emulsion oil tank when the valve is moved from the spray on to the spray off position;

providing an emulsion rejuvenator assembly located on the emulsion tank, the emulsion rejuvenator having an auger section with an auger blade vertically mounted in a support cage located within the interior of the emulsion oil tank, the auger blade having a series of at least three helically arranged Elites which are arranged perpendicular to the bottom wall of the emulsion tank, actuation of the auger blade serving to agitate emulsion oil in the tank to prevent separation of the emulsion oils contained therein, the emulsion rejuvenator having a bi-directional auger motor for turning the auger blade when the motor is switched from an off state to an on state;

wherein a hydraulic valve body is provided for supplying a control signal simultaneously to both the emulsion pump and to the emulsion rejuvenator motor to power the same on and off simultaneously, whenever the operator actuates the spray wand or turns on the emulsion pump, whereby powering the emulsion pump motor causes emulsion oil to be pumped from the pump inlet to the pump outlet and to the selector valve and from the selector valve to the spray wand to be dispensed by the spray wand when the spray wand is in the spray on position and back to the emulsion oil tank when the spray wand is in the spray off position, the simultaneous actuation of the rejuvenator motor each time the operator powers the emulsion pump on causing the auger blade to move to further agitate the emulsion oil within the emulsion oil tank, actuation of the hydraulic valve body causing hydraulic fluid flow to be partially diverted through, a first hydraulic flow controller to the bi-directional auger motor of the emulsion rejuvenator assembly, hydraulic fluid also being allowed to flow back to the inlet of the emulsion pump through a second hydraulic flow controller;

dispensing the emulsion oil from the emulsion oil tank through the hand held wand onto the pothole to be repaired in order to prepare the surface thereof; and dispensing asphalt mix materials from the hopper compartment to fill and repair the pothole.

* * * * *